US008116505B2

(12) United States Patent
Kawasaki-Hedges et al.

(10) Patent No.: US 8,116,505 B2
(45) Date of Patent: Feb. 14, 2012

(54) SPEAKER APPARATUS AND DISPLAY APPARATUS WITH SPEAKER

(75) Inventors: Philip John Kawasaki-Hedges, Tokyo (JP); Shinpei Kondo, Tokyo (JP); Hiroyuki Yoshida, Kanagawa (JP)

(73) Assignee: Sony Corporation (JP)

( * ) Notice: Subject to any disclaimer, the term of this patent is extended or adjusted under 35 U.S.C. 154(b) by 1090 days.

(21) Appl. No.: 12/002,937

(22) Filed: Dec. 19, 2007

(65) Prior Publication Data

US 2008/0159582 A1 Jul. 3, 2008

(30) Foreign Application Priority Data

Dec. 29, 2006 (JP) ..... P2006-356828

(51) Int. Cl.
*H04R 1/02* (2006.01)

(52) U.S. Cl. ..... 381/388; 381/386

(58) Field of Classification Search ..... 381/386, 381/388

See application file for complete search history.

(56) References Cited

U.S. PATENT DOCUMENTS 5,818,942 A * 10/1998 Freadman ..... 381/300
6,687,380 B1 * 2/2004 Vishwamitra ..... 381/386

FOREIGN PATENT DOCUMENTS

JP 3473279 B2 1/1998
JP 2006-311324 A 11/2006

* cited by examiner

*Primary Examiner* — Roy Potter

(74) *Attorney, Agent, or Firm* — Lerner, David, Littenberg, Krumholz & Mentlik, LLP

(57) ABSTRACT

A speaker apparatus arranged in a predetermined casing includes a speaker unit disposed at a predetermined position in the casing, a speaker grill section whereto sound output holes are provided, and the speaker grill section being disposed on the front of a sound output surface locating at the position of the speaker unit in the casing, while a predetermined distance is kept from the speaker unit, a first front air chamber which is disposed between the speaker unit and the speaker grill section in the casing, and separated from other sections in the casing, and a second front air chamber extending from the first front air chamber on the front of the speaker unit.

7 Claims, 6 Drawing Sheets

CROSS-SECTIONAL VIEW TAKEN ALONG LINE II - II

EXAMPLE OF EQUIPMENT CONFIGURATION

CROSS-SECTIONAL VIEW TAKEN ALONG LINE II - II

EXPLODED PERSPECTIVE VIEW
AS VIEWED FROM FRONT SIDE

CONNECTING SECTION OF SPEAKER UNIT AND BAFFLE

MOUNTING STATE OF BAFFLE

EXAMPLE OF BAFFLE

SPEAKER APPARATUS AND DISPLAY APPARATUS WITH SPEAKER

BACKGROUND OF THE INVENTION

1. Field of the Invention

The present invention relates to a speaker apparatus suitable for use in, for example, speakers for television receivers, and to a display apparatus with speaker which houses the speaker apparatus.

2. Description of Related Art

Recently, in image display apparatuses such as television receivers, the prevailing image display means are those using a flat display panel such as a liquid crystal display panel. In the display apparatuses using the flat display panel such as a liquid crystal display, a casing which forms the main body of the display apparatus is flat, and therefore, a speaker housed in the display apparatus is also required to be made flat.

Japanese Patent Application Publication No. JP 2006-311324 (Patent Document 1) discloses an example where speakers are incorporated into the right and left of a flat image display apparatus, respectively. Japanese Patent Application Publication No. JP 10-23582 (Patent Document 2) discloses formation of a certain degree of space at the front of a speaker unit when incorporating speakers into a casing which forms the main body of this type of apparatus.

SUMMARY OF THE INVENTION

The incorporation of the speaker apparatus into the flat image display apparatus necessitates to make the speaker apparatus thin. However, thinned the speaker apparatus is not preferable in terms of sound quality. That is, the speaker apparatus is designed such that a speaker box having a certain degree of volume is disposed on the back side of a speaker unit which includes a diaphragm and a magnetic circuit for driving the diaphragm. Echoes in the speaker box are used to efficiently output sounds from the speaker unit. Thus if the apparatus is made thin, a sufficient volume of the speaker box is difficult to be kept in designing an image display apparatus. It is therefore important to ensure good sound quality of speakers in electronic equipments such as flat image display apparatuses.

According to an embodiment of the present invention, it is desirable to improve the sound quality of speakers housed in electronic equipments such as flat image display apparatuses.

An embodiment of the present invention is applicable to a speaker apparatus arranged in a predetermined casing, or to a display apparatus with speaker which houses the speaker apparatus. The configuration thereof includes a speaker unit disposed at a predetermined position in a casing, and a speaker grill section formed with sound output holes, disposed at a position with a predetermined distance kept from the speaker unit on the front of a sound output surface locating at the position of the speaker unit of the casing. A first front air chamber is formed between the speaker unit and the speaker grill section in the casing, and separated from other sections in the casing. A second front air chamber is formed which extends from the first front air chamber on the front of the speaker unit.

With this configuration, the quality of sound outputted from the speaker grill may be improved by the action of the front air chamber provided in front of the speaker unit. Particularly, in an embodiment of the present invention, by the conjoint action of the first front air chamber disposed on the front of the speaker unit and the second front air chamber connected to the first front air chamber, sound may be echoed satisfactorily in a relatively large space during the time the sound outputted from the speaker unit is outputted from the speaker grill section. This enables reproduced sound to be improved effectively.

DETAILED DESCRIPTION OF THE EMBODIMENTS

An embodiment of the present invention will be described below with reference to the accompanying drawings.

The present embodiment is concerned with an example applied to a television receiver as an electronic equipment.

Figure 1:
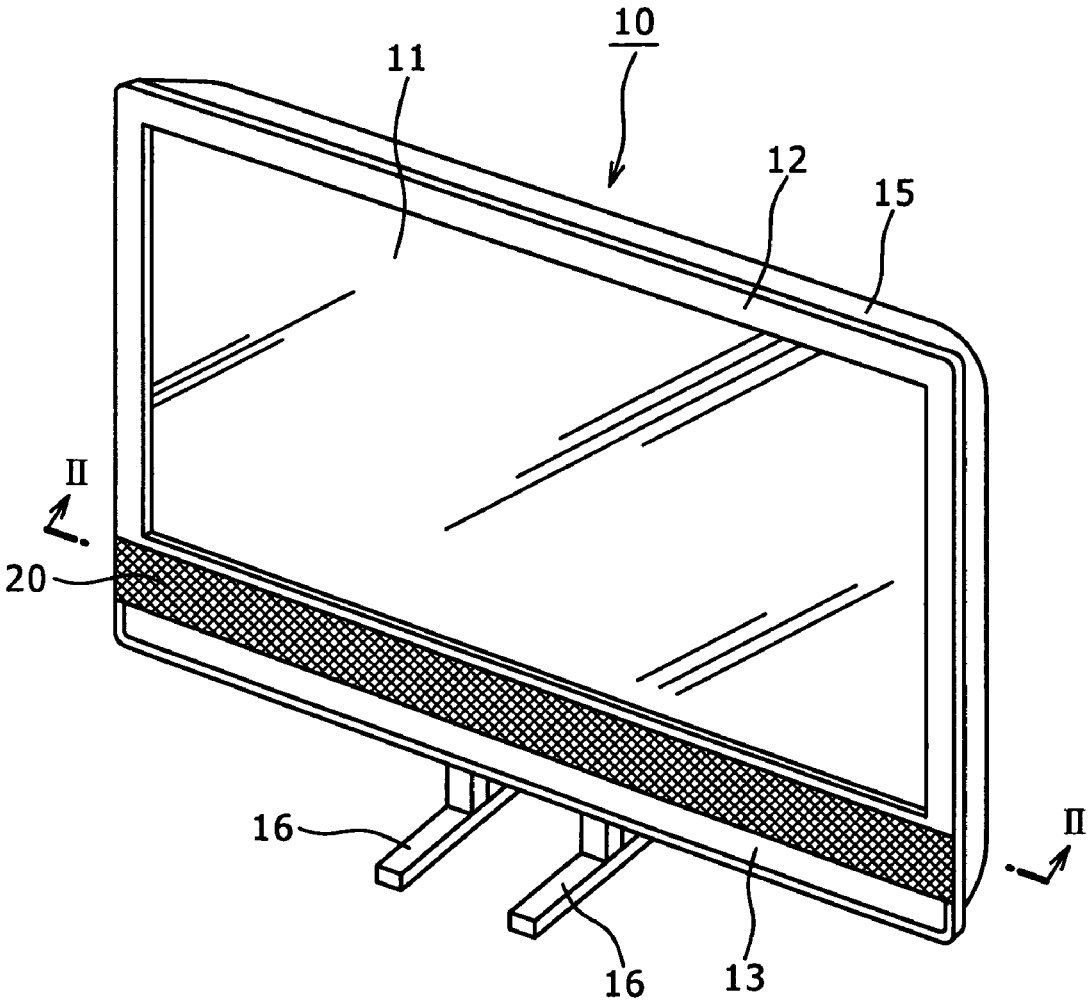
FIG. 1 is a perspective view showing a whole configuration example of equipment according to an embodiment of the present invention.

FIG. 1 is a perspective view showing a whole configuration example of the television receiver. A television receiver 10 is configured as a flat display using a liquid crystal image display panel or a plasma image display panel, assuming a relatively large screen size, such as 30-inch, a 40-inch, or more.

In the surroundings of a display panel 11 disposed centrally of the front of the television receiver 10, a front panel 12 is arranged such that it surround four sides of the display panel 11. The front panel 12 is integrally formed by synthetic resin. The front panel 12 is connected to a rear cover 15, to form a casing of the main body of the television receiver. The rear cover 15 is also integrally formed by synthetic resin.

A speaker grill 20 for outputting the sound from a speaker is disposed below the front panel 12. The speaker grill 20 is of oblong and horizontally long slender shape, and has substantially the same length as that of the width of the display panel 11. The speaker grill 20 has a plurality of tiny holes arranged at constant intervals and, through the holes the sound from the inside speaker unit is outputted. For example, the holes having a diameter of approximately 1 mm, are arranged both longitudinally and laterally at intervals of approximately 2 mm. As will be described later, a part (the central section) of the speaker grill 20 provided with the tiny holes is a section through which no sound from the speaker unit is outputted. Although the holes are constantly arranged on the surface of the speaker grill 20, at the section, from which no sound from the speaker unit is outputted, the holes are not configured to pass through the internal surface. Since the holes are arranged constantly with substantially same interval as the width of the display panel 11 kept, the speaker grill 20 has an excellent design.

A speaker front decorative panel 13 has a configuration in that a resin sheet and a fabric sheet, and the like, having tiny holes are arranged such that the sound outputted from the speaker unit (not shown) disposed at the rear of the speaker front decorative panel 13 may be outputted to the exterior.

The decorative panel 13 is disposed below the speaker grill 20 of the television receiver 10 in the present embodiment. For example, the decorative panel 13 is shaped as a mirror, and incorporates partially a lighting section for various pilot lamps and a light receiving section of remote control signals. When the television receiver 10 is installed by placing it on television stands (not shown), legs (stands) 16 are fixed to lower sections of the television receiver 10, as shown in FIG. 1. When installed to the wall, fixing of the legs 16 is not required.

Next, the configuration of the speaker apparatus housed in the television receiver 10 will be described with reference to FIG. 2 and the succeeding drawings.

Figure 2:
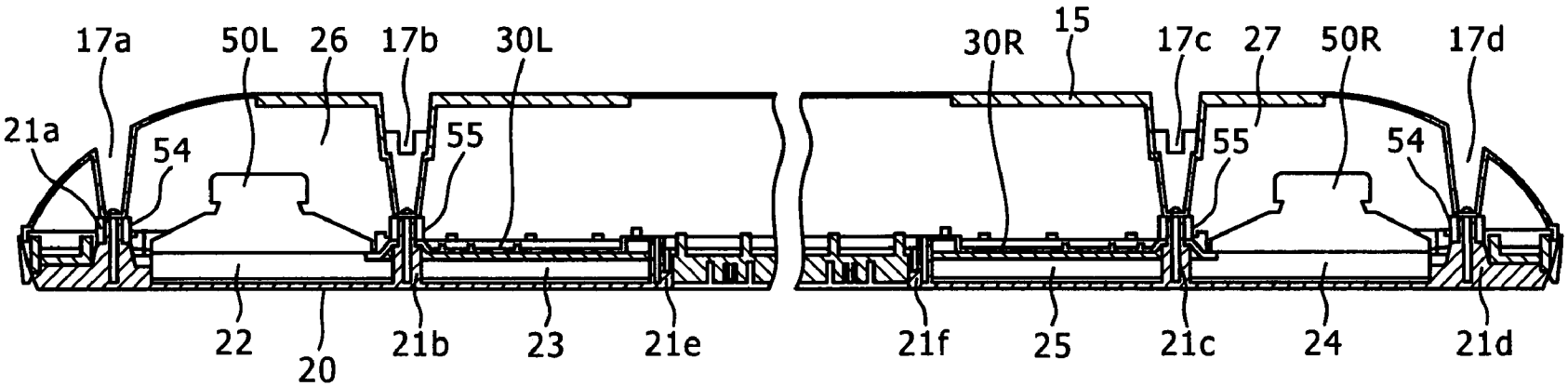
FIG. 2 is a cross-sectional view taken along the line II-II in FIG. 1.

FIG. 2 is a transverse cross-sectional view taken along the line II-II in FIG. 1, and when viewed from the front, it shows the inside of the casing at the section where the speaker grill 20 is disposed. However, in FIG. 2, the vicinity around the center of the corresponding cross-section is omitted by breaking away. As shown in FIG. 2, the casing as the main body of the television receiver 10 is configured such that the front panel 12 with the speaker grill 20 and the rear cover 15 are connected. For connecting the front panel 12 and the rear cover 15, screw hole portions 21*a*, 21*b*, 21*c* and 21*d* are disposed at the side of the front panel 21 with predetermined intervals kept, and screw fitting portions 17*a*, 17*b*, 17*c* and 17*d* are disposed at the side of the rear cover 15 which is opposite positions of respective hole portions. The front panel 12 and the rear cover 15 may be assembled integrally by threading screws (not shown) from the screw fitting portions 17*a*, 17*b*, 17*c* and 17*d* to the screw hole portions 21*a*, 21*b*, 21*c* and 21*d*, respectively. At the time of the threading, fixing rubbers 54 and 55 are interposed between the screw fitting portions 17*a*, 17*b*, 17*c* and 17*d* and the screw hole portions 21*a*, 21*b*, 21*c* and 21*d*, respectively.

Speaker units 50L and 50R are disposed at the left end and the right end, respectively, in the section of the casing where the speaker grill 20 is disposed. The left speaker unit 50L is a speaker unit for outputting sound composed of audio signals of the left channel synchronized with images displayed on the television receiver 10. The right speaker unit 50R is a speaker unit for outputting sound composed of audio signals of the right channel synchronized with images displayed on the television receiver 10.

The speaker units 50L and 50R have the same shape, namely full-range type speaker units using elliptic cone-type diaphragms, respectively. As shown in FIG. 2, a predetermined clearance is formed between the speaker grill 20 and the sound output surfaces of the speaker units 50L and 50R, respectively. In the present embodiment, the abovementioned clearance is used as a front air chamber separated from other space in the casing.

Specifically, a front air chamber 22 (a first front air chamber) is disposed between the sound output surface of the speaker unit 50L and the speaker grill 20. An extended front air chamber 23 (a second front air chamber) extending toward the center along the speaker grill 20 is connected to the front air chamber 22. Similarly, a front air chamber 24 is disposed between the sound output surface of the speaker unit 50R and the speaker grill 20. An extended front air chamber 25 extending toward the center along the speaker grill 20 is connected to the front air chamber 24. As shown in FIG. 2, the front air chamber 22 of the left channel, the extended front air chamber 24 of the left channel, the extended front air chamber 25 of the right channel, and the front air chamber 23 of the right channel are arranged sequentially.

The front air chamber 22 for the left channel and its extended front air chamber 24 are connected such that air flow therethrough, and separated from other sections in the casing. Similarly, the front air chamber 24 for the right channel and its extended front air chamber 25 are connected such that air flow therethrough, and separated from other sections in the casing.

Baffles 30L and 30R are disposed at the rear of the extended front air chambers 24 and 25, respectively, such that they cover the back. Screw hole portions 21*e* and 21*f* shown in FIG. 2 are screw holes for fixing the baffles 30L and 30R, respectively.

At the rear of the speaker units 50L and 50R, sealed spaces 26 and 27 forming a speaker box are formed in the casing. The shapes of these sealed spaces 26 and 27 included in the speaker box are determined depending on the shape of the rear cover 15.

Figure 3:
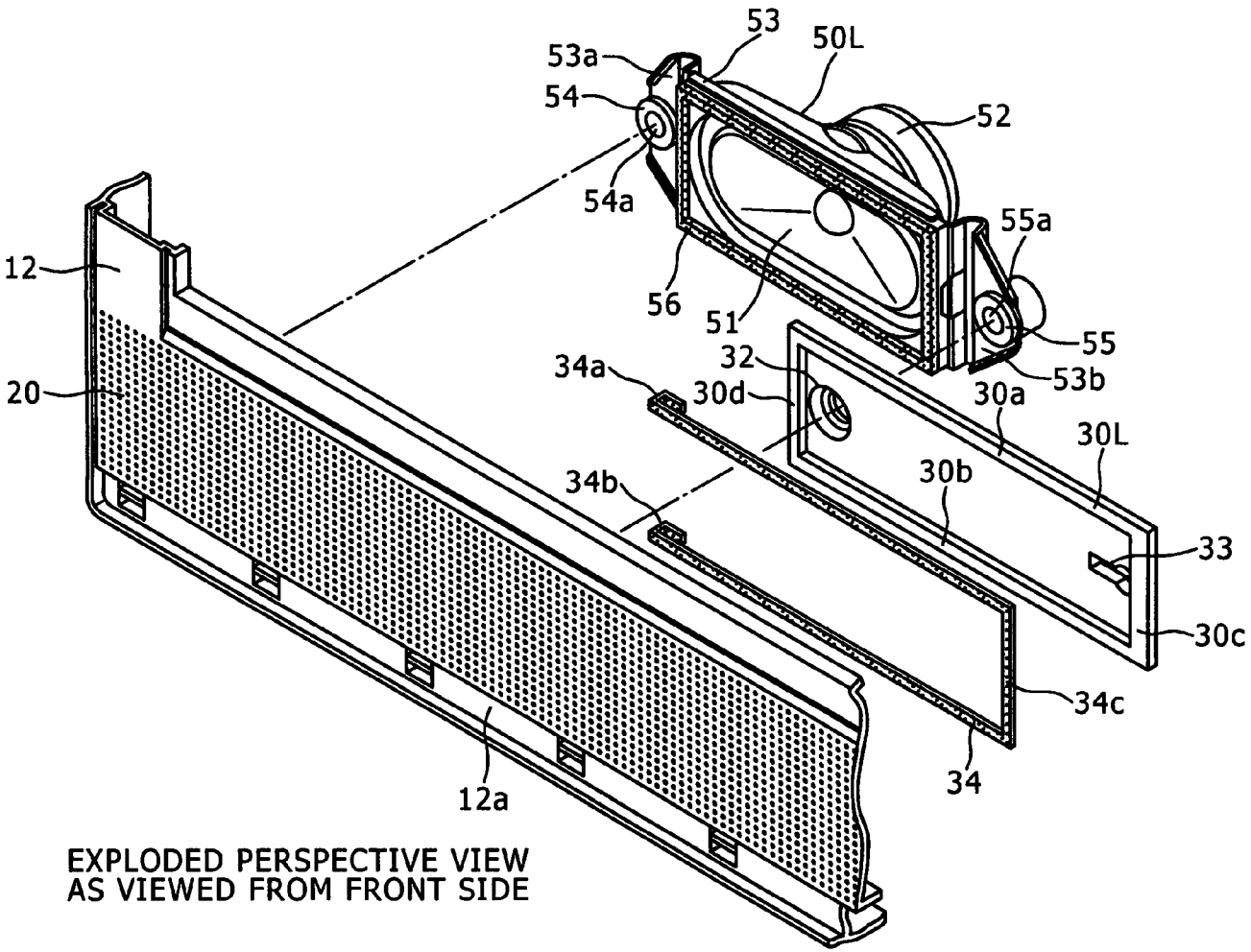
FIG. 3 is an exploded perspective view as viewed from the front of a main section in the first embodiment of the present invention.

Referring to FIGS. 3 to 7, a description will be made of the configurations of the front air chambers 22 and 23 and the extended front air chambers 24 and 25, which are interposed between the speaker grill 20 and the speaker units 50L and 50R, respectively, as well as the configuration of the peripheral thereof. In FIG. 3 and the succeeding drawings, the configurations of the speaker unit 50L for the left channel and the surrounding thereof are shown, with the configuration of the right channel side omitted. The right and left channels sides have the same shape and a laterally symmetrical configuration.

Figure 4:
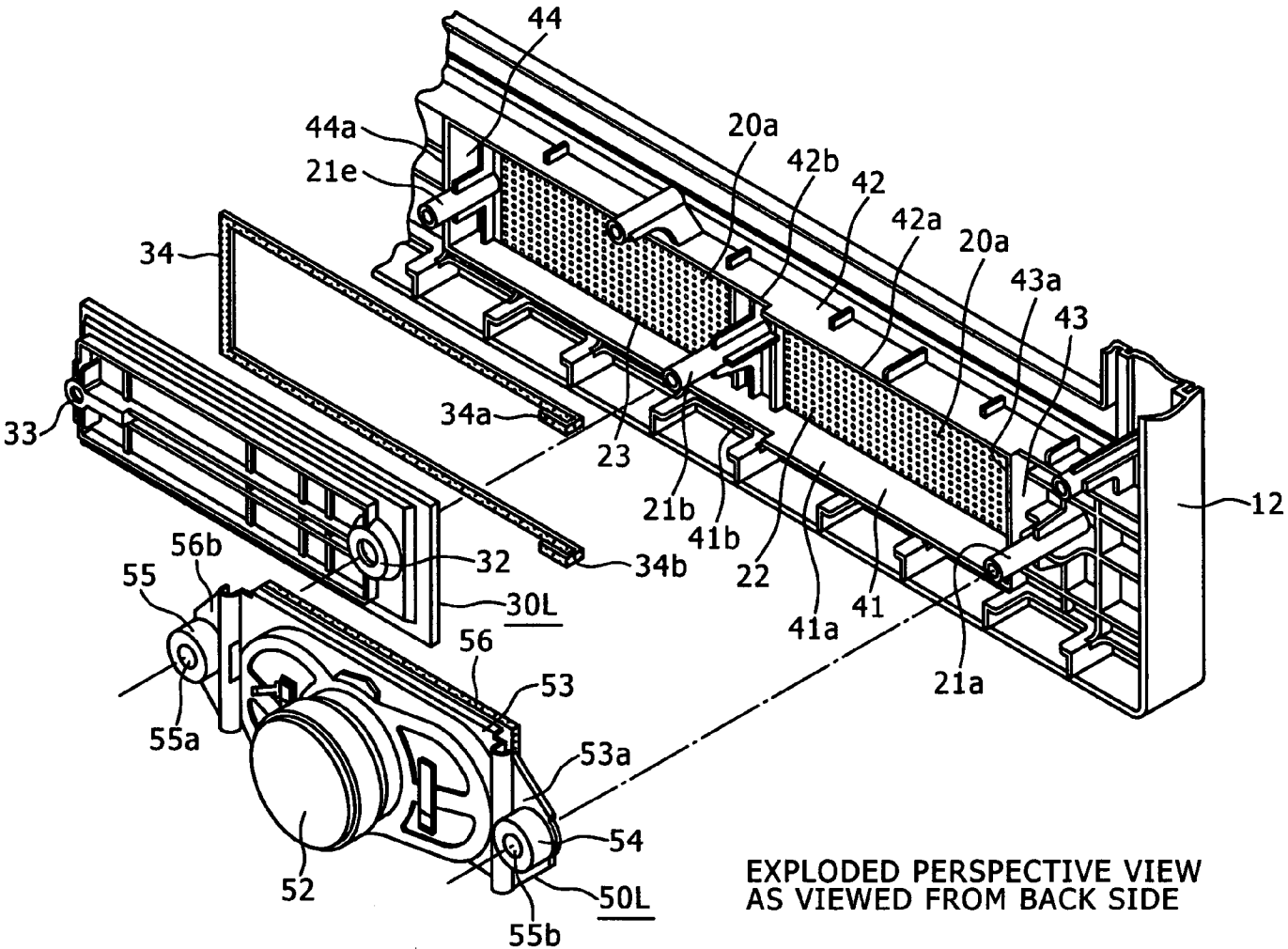
FIG. 4 is an exploded perspective view as viewed from the back of the main part in the first embodiment of the present invention.

FIG. 3 is an exploded view as viewed from the front, showing the configuration in the vicinity of the speaker unit 50L and the speaker grill 20. FIG. 4 is an exploded view as viewed from the back. As shown in these drawings, the speaker unit 50L has an elliptic diaphragm 51 and a magnetic circuit 52 for driving the diaphragm 51, and a metal frame 53 is integrally mounted to the outer peripheral section of the speaker unit. The frame 53 has left and right extended sections 53*a* and 53*b*, and fixing rubbers 54 and 55 are fit to the extended section 53*a* and 53*b*, respectively. Holes 54*a* and 55*a* for threading are disposed at the center of the fixing rubbers 54 and 55, respectively. Holes corresponding to the respective holes 54*a* and 55*a* are also disposed at the frame 53 side. A rectangular seal member 56 is stuck to the outer peripheral section of the diaphragm 51 of the frame 53. Specifically, the seal member 56 is formed of an elastic resin member such as urethane resin, namely a band-shaped member that has a several mm in width and thickness, is provided such that it surrounds a rectangular periphery of the diaphragm 51.

As shown in FIG. 4, the speaker unit 50L is secured by fitting the fixing rubbers 54 and 55 of the speaker unit 50L to the screw hole portions 21*a* and 21*b* at the side of the front panel 12, and then threading them from their respective backs. Side sections 41, 42, 43 and 44 are integrally formed, by resin molding, with the front panel 12 on the front side corresponding to the position where the speaker unit 50L is fixed.

The section surrounded by the side sections 41, 42, 43 and 44 corresponds to a speaker grill internal surface 20*a*, through which the holes provided as the speaker grill are passed. The spaces surrounded by the side sections 41, 42, 43 and 44 are the front air chamber 22 and the extended front air chamber 23. As shown in FIGS. 3 and 4, the speaker unit 50L is disposed in the front air chamber 22, and the baffle 30L is disposed in the extended front air chamber 23.

The baffle 30L is a rectangular plate-shape member formed by resin molding, and has holes 32 and 33 for threading. A seal member 34 is stuck to the edge on the surface side of the baffle 30L (the side attached to the front panel 12). The seal member 34 is also formed as a band-shaped member by using an elastic resin member such as urethane resin, which is about a several mm in both width and thickness.

Figure 7:
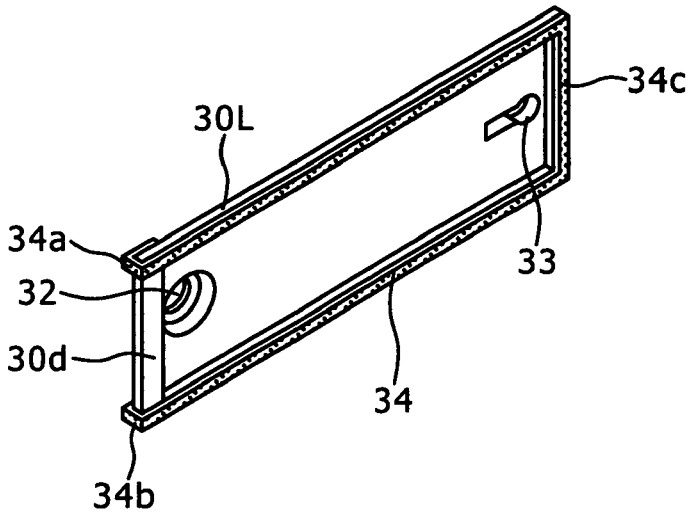
FIG. 7 is a perspective view showing an example of the baffle in the first embodiment of the present invention.

Although the seal member 34 is shown as a separated member in FIGS. 3 and 4, it is stuck as shown in FIG. 7, and then attached to the front panel 12. That is, as shown in FIG. 3, the seal member 34 is disposed at three side edges 30*a*, 30*b* and 30*c* on the surface side of the oblong and rectangular baffle 30L, and the seal member 34 is not disposed at a rest side edge 30*d*. End portions 34*a* and 34*b* of the seal member 34 are disposed such that it is folded back against the back side of the edge 30*d*. A middle section 34*c* of the seal member 34 is disposed at the edge 30*c* facing to the edge 30*d*. A double face adhesive tape or adhesive is used to stick the seal member 34 to the baffle 30L.

A description will next be made of a state in which the speaker unit 50L and the baffle 30L thus configured is mounted on the front panel 12.

By fixing the speaker unit 50L and the baffle 30L to the vicinity of the speaker grill internal surface 20*a* on the back of the front panel 12, the front air chamber 22 and the extended front air chamber 23 are formed between the speaker grill internal surface 20*a* and the speaker unit 50L and the baffle 30L, respectively. The front air chamber 22 and the extended front air chamber 23 are arranged in series and become conductive with the exterior only through the sound output holes provided in the speaker grill internal surface 20*a*, in the sealed spaced blocked by the surroundings in the casing.

For forming the front air chamber 22 and the extended front air chamber 23 as the sealed space, wall sections 41, 42, 43 and 44 are arranged around the speaker grill internal surface 20*a*. As shown in FIG. 4, mounting of the speaker unit 50L enables that parts of the tip faces 41*a* and 42*a* of the upper and lower wall sections 41 and 42, and a tip face 43*a* of the wall section 43 adjacent to one end (the right end in FIG. 4) are contacted with the seal member 56 secured to the frame 53 of the speaker unit 50L. Shoulder portions 41*b* and 42*b* are interposed in the tip faces 41*a* and 42*b*, respectively.

Mounting the baffle 30L enables that the rest portions of the tip faces 41*a* and 42*a* of the upper and lower wall sections 41 and 42, and the tip face 44*a* of the wall section 44 adjacent to the center are contacted with the seal member 34 secured to the baffle 30L. Further, the edge 30*d* (FIG. 3) of the baffle 30L is contacted with the seal member 56 located on the side of the speaker unit 50L.

Figure 5:
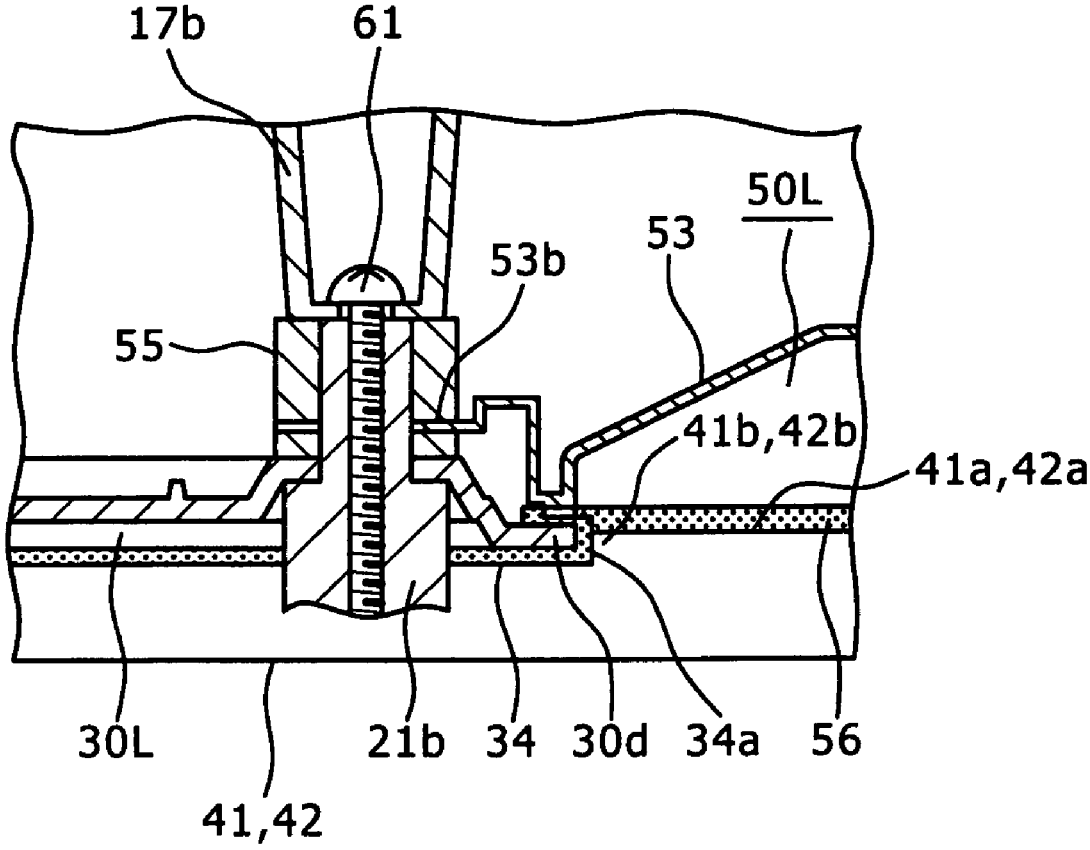
FIG. 5 is a cross-sectional view of a connecting section between a speaker unit and a baffle in the first embodiment of the present invention.

FIG. 5 is a cross-sectional view of the assembled state of a connecting portion between the speaker unit 50L and the baffle 30L. The speaker unit 50L and the baffle 30L may be secured by threading a screw 61 into a common screw hole portion 21*b*. At the time of mounting, the hole 33 for threading the baffle 30L is set to be the front side (the lower side in FIG. 5), and the extended portion 53*b* of the frame 53 of the speaker unit 50L is arranged at the rear side such that it overlaps the front side (the upper side in FIG. 5). At this time, the section folded back against the rear side of the end portions 34*a* and 34*b* of the seal member 34 located on the baffle 30L makes contact with the seal member 56 located on the speaker unit 50L, and abuts against the tip faces 41*a* and 42*b* of the wall sections 41 and 42, and shoulder portions 41*b* and 42*b*, respectively. This enables sealed-up connection between the baffle 30L and the speaker unit 50L. In the state of not being threaded by the screw 61 as shown in FIG. 5, the baffle 30L and the speaker unit 50L are slightly lifted from their respective normal positions due to the thickness of the seal member 34 of the baffle 30L and the thickness of the seal member 56 of the speaker unit 50L. Threading for securing by the screw 61 enables deformation of the seal members 34 and 56, such that the baffle 30L and the speaker unit 50L are positioned at their normal positions to be connected in sealed-up manner.

Figure 6:
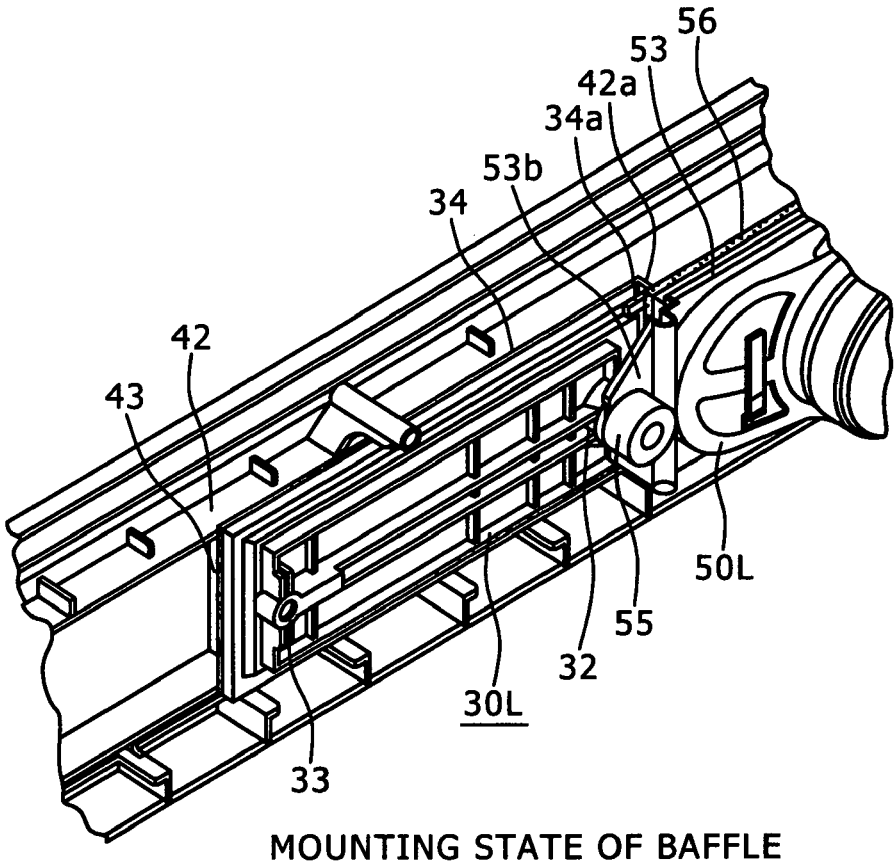
FIG. 6 is a partial perspective view showing an example of the mounting state of the baffle in the first embodiment of the present invention.

FIG. 6 shows a state where the speaker unit 50L and the baffle 30L are mounted to the internal surface of the speaker grill 20 of the front panel 12. The speaker unit 50L and the baffle 30L are arranged such that they cover the respective wall sections 41 to 44. The clearance between the speaker unit 50L and the baffle 30L is absorbed by the shoulder portions 41*b* and 42*b* of the wall sections 41 and 42 as shown in FIG. 4.

Thus, when the speaker unit 50L and the baffle 30L are mounted on the back of the front panel 12, they are connected with the wall sections 41, 42, 43 and 44 in a sealed-up manner with the seal members 34 and 56 in between. Therefore, the front air chamber 22 and the extended front air chamber 23 can be kept as a sealed space from other space in the casing.

Under the configuration, the presence of the front air chamber 22 and the extended front air chamber 23 enable the sound outputted from the speaker unit 53L to be echoed in the space within the front air chamber 22 and the extended front air chamber 23, whereby the sound outputted from the speaker grill 20 on the front side may have excellent sound characteristics. Particularly in the present embodiment, the coexistence of the front air chamber 22 and the extended front air chamber 23 connected thereto on the front of the speaker unit 50L may allow a large space kept as the front air chamber to improve sound quality. Additionally, owing to the tiny sound output holes provided on the speaker grill 20 on the front side of the extended front air chamber 23, both of the front air chambers 22 and 23 perform the sound output to the front side, thus enables sound output from a large widthwise range. This enables sound output in accordance with the mounting state of the display panel 11 (FIG. 1).

Similarly, by the conjoint action of the front air chamber 24 and the extended front air chamber 25, the sound output from the speaker unit 50R on the right channel side allows excellent sound output.

By virtue of the excellent sound output performance, the speaker apparatus having excellent sound quality may be incorporated into the casing of the television receiver using the flat display panel.

Further, as shown in FIG. 2 or the like, in accordance with the present embodiment, the front air chambers 22 and 24, each housing the speaker unit, are disposed at the positions relatively adjacent to the left and right ends of the casing included in the television receiver, respectively, and the extended front air chambers 23 and 25 are disposed more adjacent to the center compared with the front air chambers 22 and 24, respectively. These enable separate arrangement of the speaker units 50L and 50R of the left and right channels. Therefore, by the conjoint action of the extended front air chambers 23 and 25, the sound quality may be improved while ensuring separation of the left and right channels. This permits excellent performance as a speaker for display apparatuses such as television receivers.

Although in the foregoing embodiment the extended front air chambers 23 and 25 are arranged at the positions adjacent to the center, from the left and right front air chambers 22 and 24 positioned in front of the speaker unit, these extended front air chambers may be arranged outside of the left and right front air chambers 22 and 24 positioned in front of the speaker unit. Alternatively, for the purposes of further increasing the capacity of the front air chamber, other extended front air chambers may be further disposed outside of the left and right front air chambers 22 and 24, in addition to the extended front air chambers 23 and 25 positioned adjacent to the center as shown in FIG. 2 or the like.

Although the foregoing embodiment employs, as a speaker grill, the grill section having the tiny holes formed in series by resin molding, but other speaker grill may be employed. For example, speaker grills having various configurations are applicable, such as a speaker grill formed by sticking a fabric-like member called saran-net etc to the front, a speaker grill formed by sticking a resin sheet with tiny holes provided, or a metal mesh speaker grill. It is however necessary to properly select the shape and the material of the speaker grill because when the aperture area (the size of holes etc) of the speaker grill section is too large, the front air chamber behind the speaker grill section may not function well in terms of sound characteristics.

Although in the embodiment, the speakers are arranged below the display panel forming the television receiver, the left channel speaker may be arranged lengthwise along the left side of the display panel, and the right channel speaker may be arranged lengthwise along a right side of the display panel.

Although the equipment described in the foregoing embodiment is applied to the speaker apparatus housed in the image display apparatus configured as a television receiver, it may be applied to a speaker apparatus housed in a casing that forms other display apparatus. Alternatively, the equipment is applicable to various electronic equipments where the speaker apparatus is housed in a casing other than that of the display apparatus.

According to an embodiment of the present invention, by the conjoint action of the first front air chamber disposed on the front of the speaker unit and the second front air chamber connected to the first front air chamber, sound may be echoed satisfactorily in a relatively large space during the time the sound outputted from the speaker unit is outputted from the speaker grill section. This enables reproduced sound to be improved effectively.

It should be understood by those skilled in the art that various modifications, combinations, sub-combinations and alterations may occur depending on design requirements and other factors insofar as they are within the scope of the appended claims or the equivalents thereof.

The present document contains subject matter related to Japanese Patent Application No. 2006-356828 filed in the Japanese Patent Office on Dec. 29, 2006, the entire content of which being incorporated herein by reference.

What is claimed is:

1. A speaker apparatus arranged in a predetermined casing, comprising:

a speaker unit disposed at a predetermined position in the casing;

a speaker grill section formed with sound output holes, the speaker grill section being disposed on the front of a sound output surface locating at the position of the speaker unit in the casing, while a predetermined distance is kept from the speaker unit;

a first front air chamber which is disposed between the speaker unit and the speaker grill section in the casing, and separated from other sections in the casing; and a second front air chamber extending from the first front air chamber on the front of the speaker unit.

2. The speaker apparatus according to claim 1, wherein:

the speaker grill section whereon sound output holes are provided is disposed on the front of the second front air chamber.

3. The speaker apparatus according to claim 1, wherein:

the second front air chamber is separated from other sections in the casing by a baffle plate disposed side by side to the speaker unit.

4. The speaker apparatus according to claim 3, wherein:

the baffle plate is mounted into the casing with a predetermined seal member in between.

5. A display apparatus with speaker having a speaker in a casing where a display section is arranged, comprising:

a speaker unit disposed at a predetermined position in the casing;

a speaker grill section formed with sound output holes, the speaker grill section being disposed on the front of a sound output surface locating at the position of the speaker unit in the casing while a predetermined distance is kept from the speaker unit;

a first front air chamber disposed between the speaker unit and the speaker grill section in the casing, and separated from other sections in the casing; and a second front air chamber extending from the first front air chamber on the front of the speaker unit.

6. The display apparatus with speaker according to claim 5, wherein:

the first front air chamber and the second front air chamber are arranged in series along a side of the display section, and the speaker grill section is arranged in series along the side of the display section.

7. The display apparatus with speaker according to claim 6, wherein:

the speaker unit includes a left channel speaker unit and a right channel speaker unit, wherein;

a first front air chamber of the left channel speaker unit and a first front air chamber of the right channel speaker unit are disposed at separate portions, and the second front air chambers for the right and left channels are disposed between the two first front air chambers such that the chambers are arranged in series along the side of the display section.

* * * * *